United States Patent [19]

Sterling et al.

[11] 4,306,377

[45] Dec. 22, 1981

[54] DOOR SUSPENSION

[75] Inventors: John G. Sterling, Crystal Lake, Ill.; Richard G. Kluge, Pell Lake, Wis.

[73] Assignee: John Sterling Corporation, Richmond, Ill.

[21] Appl. No.: 148,826

[22] Filed: May 12, 1980

[51] Int. Cl.[3] ..... E05D 15/36

[52] U.S. Cl. ..... 49/250; 49/260; 49/390; 16/166

[58] Field of Search ..... 49/250, 254, 260, 261, 49/215, 390; 16/166

[56] References Cited

U.S. PATENT DOCUMENTS

| | | | |
|---|---|---|---|
| 1,109,769 | 9/1914 | Lawrence | 49/260 |
| 1,223,697 | 4/1917 | Janse | 49/260 |
| 1,448,845 | 3/1923 | Johnson et al. | 49/260 |
| 1,604,341 | 10/1926 | Duncanson | 49/250 |
| 1,604,368 | 10/1926 | Smith | 49/260 |
| 2,143,704 | 1/1939 | Kufner | 49/260 X |
| 2,590,028 | 3/1952 | Miller | 49/260 X |
| 3,027,606 | 4/1962 | Nicklas | 49/260 |
| 3,113,338 | 12/1963 | Westlund | 49/260 X |

*Primary Examiner*—Philip C. Kannan

*Attorney, Agent, or Firm*—McCaleb, Lucas & Brugman

[57] ABSTRACT

Suspension hardware for interior doors, such as closet or wardrobe doors and the like, incorporating overhead and floor mounted hardware assemblies, each incorporating a pair of angularly intersecting track means; the track means of cooperating assemblies being aligned in superposed registry in operation. One track means of each assembly parallels the wall in which the door opening is formed while the other track means is in intersecting relation thereto. Door brackets are affixed to the inner face of the door, adjacent its upper and lower edges, and guide members are mounted thereon for sliding movement along associated track means. Each guide member is pivotally joined to the door (via the associated door bracket) for pivotal movement about a vertical axis so that the door is movable simultaneously along the intersecting paths of the track means to produce arcuate swinging door action.

5 Claims, 9 Drawing Figures

FIG. 1
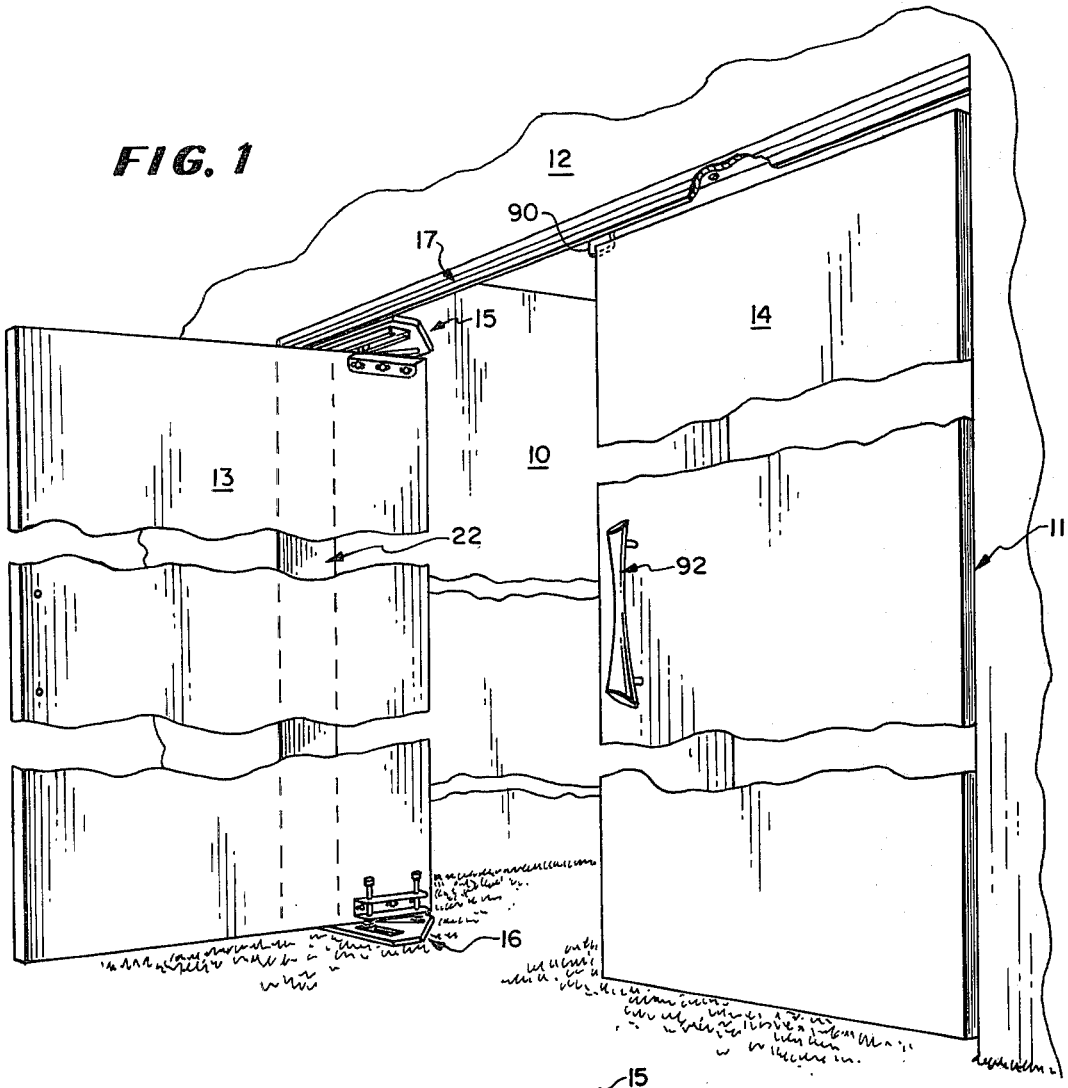
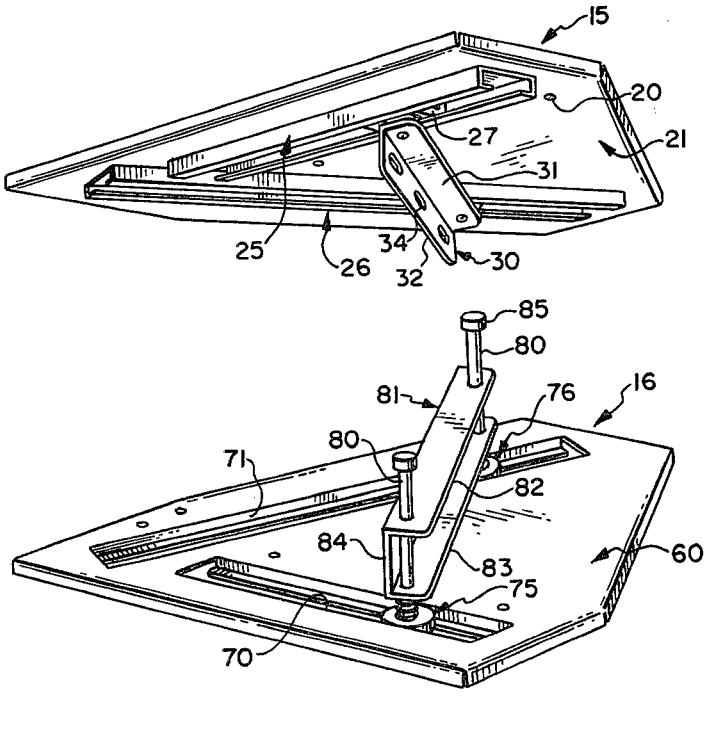
FIG. 2

DOOR SUSPENSION

BACKGROUND OF THE INVENTION

Closets or wardrobes are usually closed by a door, such as the time honored hinged door, mounted to swing outwardly from one side of the door opening. In other instances by-passing sliding doors are employed, in which one or more panels hang from overhead parallel tracks and move laterally across the door opening. In still other instances, bi-fold doors, having a plurality of hingedly interjoined narrow door panels, mounted to fold about vertical hinge axes while moving laterally along an overhead guide track are used.

By-passing doors have the advantage of being simple and relatively trouble free. However, they have the distinct disadvantage of permitting only a portion or part of the door opening to be exposed at one time. For example, with a two-panel, by-passing door installation, only one-half of the wardrobe opening is available at any one time.

Recently bi-fold doors have become popular replacements for by-passing doors, principally because they permit a greater portion of the closet or wardrobe opening to be available when in open position. However, because a by-folding door installation requires generally twice as many panels as a comparable by-passing door installation, they are more expensive. Also due to the combined sliding support and hinged interconnection of the door panels, their suspension hardware is susceptible to greater wear and maladjustment, making it more difficult to maintain a trouble free installation.

In an effort to overcome the shortcomings of the bi-folding and by-passing door installations as currently used for closet or wardrobe closures, the present invention provides a unique suspension hardware system which permits substantially full opening access to the closet interior, while using a minimum number of door panels and simplified hardware. Thus this invention incorporates advantages of a by-fold door installation while avoiding certain disadvantages of by-passing door installations.

The current invention is directed primarily toward improvements in suspension systems for use with interior doors and more particulary to improved hardware for accomplishing a combination of pivotal and sliding movements for such doors.

In brief, this invention is directed to an improved suspension system and hardware for wardrobe, closet or other interior doors, embodying intersectingly related linear guide tracks mountable adjacent the upper and lower edges of the doors and means for suspending the door from the over disposed tracks while guiding the same in the lower disposed tracks. Doors equipped according to this invention are movable simultaneously along two linear intersecting axes to effectuate a combination of pivotal and sliding door action along a resultant generally arcuate movement path. As a consequence such doors are movable between positions generally parallel to the plane of the closet opening to positions substantially at right angles to such plane. Because of the unique arrangement and construction of the hardware and suspension system of this invention, mounting the hardware directly to the underlying floor and the overdisposed header of the door frame, eliminates the need for trim jamb members. When the door is in open position, it has a foreshortened extension or projection into the room, and intrudes only a short distance into the closet space, without interfering with shelving or wall surfaces of the closet. When the door is closed across the opening, little or no gap appears between the edges of the door and the door opening. Further, since each door is independently mounted, a plurality of individual panels may be installed across a closet or wardrobe opening to accommodate extra wide closets. The hardware also is readily adapted for both left and right hand door opening movements and since the inside faces of the door panels are fully exposed to the operator in the open position of the doors, such surfaces are readily available to support accessory items, such as mirrors, shoe racks and the like without interfering with the door's operation. In addition, the suspension system is fully stable so that a door, so equipped, remains stable at a desired position along its movement path.

It is a primary object of this invention to provide an improved suspension system for interior doors, such as wardrobe or closet doors.

A further object of this invention is to provide an improved door suspension system, as aforesaid, which provides a combination of pivotal and sliding movements for a door whereby the same is movable from a "closed" position paralleling the plane of the door opening to an "open" position transverse thereto.

A still further object of this invention is to provide improved suspension hardware for interior door panels which is of simplified construction and exhibits improved economies of production, ease of installation and dependability in operation.

Another object of this invention is to provide an improved suspension system for multiple wardrobe doors and the like which affords substantially full access to the wardrobe or closet interior.

Still an additional object of this invention is to provide suspension hardware for use with wardrobe doors and the like which provides substantially full access to the wardrobe opening and permits closure of such opening with one or more doors or panels.

Having thus described this invention, the above and further objects features and advantages thereof will appear to those familiar with the art from the following detailed description of a preferred embodiment thereof, illustrated in the accompanying drawings and representing the best mode presently contemplated to enable those of skill in the art to practice the same.

IN THE DRAWINGS

FIG. 1 is a perspective showing of a typical two door installation according to this invention;

FIG. 2 is another perspective view, illustrating the door suspension hardware employed on each door in the FIG. 1 installation;

DESCRIPTION OF A PREFERRED EMBODIMENT

Figure 3:
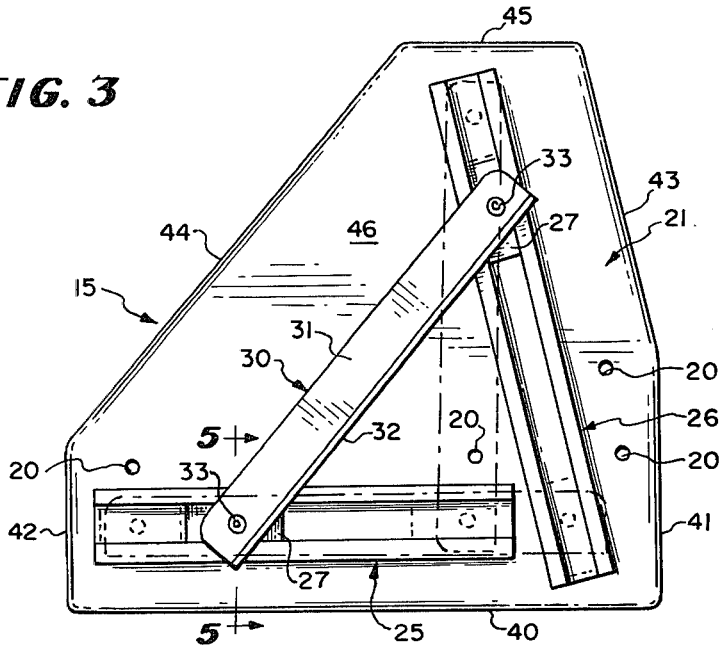
FIG. 3 is a top plan view of the overhead hardware assembly shown in FIG. 2.
Figure 4:
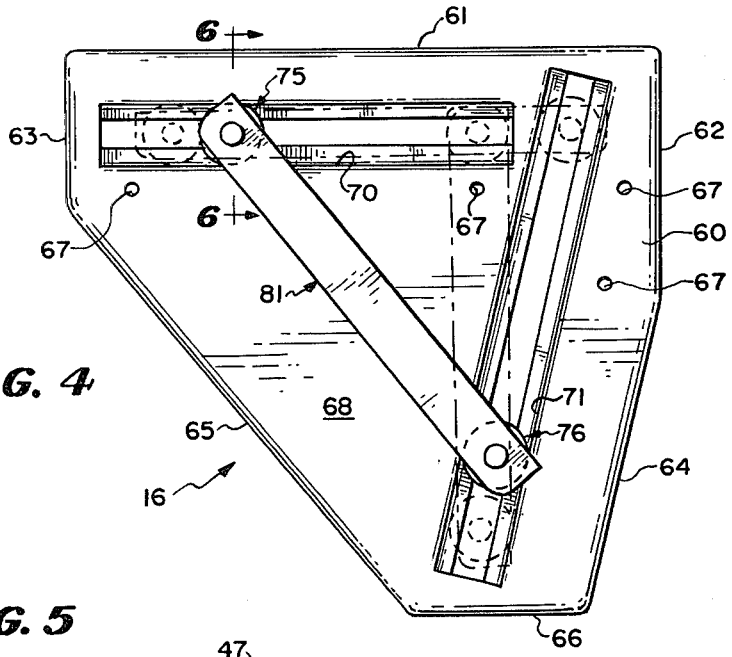
FIG. 4 is a top plan view of the ground engaging hardware assembly shown in FIG. 2.

Turning now to the features of the preferred embodiment of this invention illustrated in the accompanying drawings, initial reference is made to FIG. 1 showing a two panel or door installation as might be found in a typical wardrobe closet. As there shown, interior closet space 10 is accessible via a generally rectangular door opening 11 in wall 12 as defined by the underlying floor and vertical side frame and horizontal header members (unnumbered). A pair of panel doors 13 and 14 are mounted as closure members for the door opening.

Typically, each of the panel doors 13 and 14, in accordance with the present invention, is independently suspended or mounted by and between a pair of hardware assemblies, namely an upper or overhead hardward assembly 15 and a lower or floor-engaging hardware assembly 16, to be described in greater detail presently. Mounted across the upper margin of the door opening 11 is a depending facia member 17 which optionally may be employed to hide or disguise the overhead hardware assemblies 15.

With reference to FIG. 2 of the drawings, each of the assemblies 15 and 16 is illustrated in perspective. Specifically an assembly 15 is designed to be attached directly to the rough overhead header framing of the door opening 11 by means of long screws (not shown) mounted through opening 20 provided in a mounting plate 21. Thus the plate 21 is affixed to the overhead door frame; the mounting screws fastening to the rough header usually passing through a plastered face covering the underlying wooden header. It will be recognized from FIG. 1 in particular, that the overhead assembly 15 for door 13 is located immediately adjacent a vertical side frame member 22 of the door opening. Because there are no hinges or other fastening devices between the doors and the side frames of the door opening, there is no particular need for facing the door frame with finish trim or jamb members when using a door installation of the type herein described. Instead the rough door opening may be plastered or covered with wall board for greater economy. Similarly there is little need for face trim around the edge of the door opening, particularly if finish jamb members are eliminated.

In addition to the mounting plate 21 as hereinabove noted, assembly 15 includes a pair of linear track means, namely a lateral track 25 and a recess track 26, each comprising a short length of extruded metal of substantially U-shaped cross-section, open along its downwardly facing side for reasons which will appear presently. Each such track is receptive of a generally rectangular shaped support guide 27 which is mounted to move slidingly along its interior in operation.

The two support guides 27, 27 are joined to the door by means of a mounting angle bracket 30 formed with an upper planar platform wall 31 and an apron wall 32 depending at right angles from one margin of wall 31. Immediate connection between wall 31 and each guide 27 is by rivets 33 (see FIG. 3) defining pivot axes whereby the support guides 27 are pivotal relative to the door mounting bracket 30. Bracket 30 is adapted to be mounted near one upper inside corner margin of a door panel, as shown in FIG. 1. For that purpose, slotted openings 34, 34 are provided in apron wall 32 to receive mounting screws 35 (see FIG. 7) so that the bracket 30 may be affixed to the inside face of the door, while permitting slight longitudinal shifting of its mounted position. This feature permits adjustment of the lateral space or gap between the side edge of the door and the vertical side frame member 22 as needed.

Figure 5:
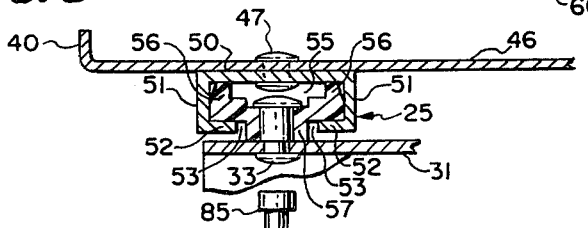
FIG. 5 is a partial, enlarged cross-sectional view taken substantially along vantage line 5—5 of FIG. 3.

With specific reference to FIGS. 3 and 5 of the drawings, the illustrated mounting plate 21 of assembly 15 is generally polygonal in plan profile to include a leading edge 40, parallel spaced side edges 41 and 42, each intersected by a angularly disposed edge portion 43 and 44 respectively. The two angularly disposed edge portions 43 and 44 also intersect a rearward edge 45 which parallels leading edge 40. Preferably the mounting plate 21 is formed from sheet metal as by stamping, with each of the edge portions 40 through 45 comprising a downwardly turned lip flange at the periphery of the generally planar main body 46 (see FIG. 5).

As noted previously, the two track means 25 and 26 are affixed to depend from one face of the body portion 46 by rivets or like fasteners 47 (see FIG. 5). Each of the particular track means illustrated, has a generally U-shaped cross section as previously mentioned, defined by a base wall 50, parallel spaced and equally dimensioned side wall portions 51, 51 depending at right angles from the lateral margins of the base wall 50 and two inwardly turned lip portions 52, 52 paralleling base wall 50 and separated by a slot or opening 53.

As shown in FIGS. 3 and 5, each of the guide means 27 comprises a generally rectangular shaped block having a U-shaped cross section adapted to fit closely with the interior of the track means 25 and 26. Specifically, each guide 27, as seen in FIG. 5 has a rectangular body portion 55 formed with upstanding arm portions 56 along its lateral margins and a central cylindrical neck portion 57 depending from the lower side of its body portion 55. Neck portion 57 extends through the open slot 53 between the portions 52, 52 of the track and may be formed separate or integral with body portion 55; the same being suitably apertured to receive a central connecting rivet 33 used to interjoin the guide means 27 with the mounting bracket 30. It will be noted that the U-shaped body portion of the guide means substantially conforms to and fills the cross section of the guide track means, but with sufficient clearance to permit free sliding movement thereof along the interior of the track means in operation. To that end the guide means 27 preferably are formed of a relatively low-friction plastic material such as Nylon, Delrin, or the like. Interconnection between bracket 30 and the guide means 27 associated with the second track means 26 is identical to that described above for guide means 27 and the lateral track means 25.

It will be understood from FIG. 3 that the lateral track means 25 are disposed in adjacent parallelism with the leading edge 40 of its mounting plate and extends partially across the lateral dimension of that plate. By way of contrast the recess track means 26 is disposed intersectingly across one end of and in angular disposition relative to the longitudinal axis of track means 25; track means 26 generally paralleling the angularly disposed edge portion 43 of its mounting plate and extending substantially between the leading edge 40 and the trailing edge 45 thereof as shown.

Figure 6:
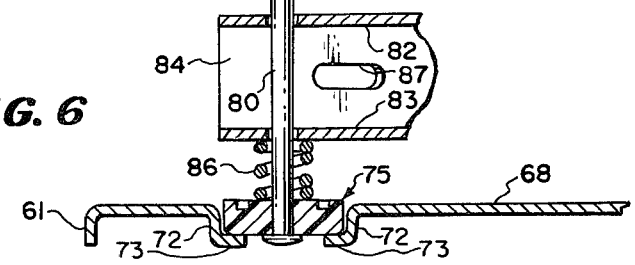
FIG. 6 is another partial, enlarged cross-sectional view, taken substantially along vantage line 6—6 of FIG. 4.

Turning now to the aspects of the floor-engaging hardware assembly 16, reference is made to FIGS. 1, 2, 4 and 6 of the drawings from which it will be recognized that assembly 16 comprises a floor engaging mounting plate 60 generally of the same order and construction as mounting plate 21 used in the upper hardware assembly 15. That is to say mounting plate 60 is generally polygonal in shape, being identical in profile to the previously described plate 21 and having a leading edge portion 61, two parallel side edge portion 62, 63 each intersected by an angularly disposed edge portion 64 and 65 respectively, and a trailing edge portion 66 paralleling leading edge 61 and intersecting the angularly disposed edge portion 64 and 65. Connection of plate 60 to the floor is accomplished by fastening screw means (not shown) which pass through openings 67 formed through the main planar body 68 of the mounting plate. Each of the described edge portions 61 through 66 comprises a downwardly turned lip flange as illustrated in FIG. 6, as in the construction of the previously described mounting plate 21.

Assembly 16 is distinguished from the upper assembly 15 principally by virtue of the fact that there are no extruded guide track members (corresponding to means 25 and 26) as such, attached to the face of body 68 in accordance with the structural arrangement employed in the upper assembly 15. While utilizing separate track elements, as in the described upper assembly, also is possible for the lower assembly, it is preferred that the track means for guiding the lower edge of the door be recessed and formed integrally with the body of the plate member 60. This may be accomplished quite simply by a slitting and stamping operation to form guide track means 70 and 71 (see FIG. 4). Guide track means 70 comprises the lateral track means and guide track means 71, the recess track means; the same being formed and disposed in the bottom assembly plate 60 for registering alignment with the overhead depending track means 25 and 26 of the upper assembly 15 in operational alignment.

More specifically, each of the track means 70, 71 is stamped inwardly of the plane of body 68 in the lower plate member 60 to provide a pair of parallel spaced, depending side wall portions 72, 72 (see FIG. 6) and a pair of inwardly turned opposingly separated bottom flange walls 73, 73, parallel to the plane of the main body 68 and located or spaced slightly above the floor level in the mounted operating position for the plate member 60. Each track means 70 and 71 is respective of a guide roller 75 and 76, respectively, (see FIG. 4) comprising a generally cylindrical roller member having a diameter conforming substantially to the lateral dimension or spacing between the depending side walls 72, 72 of the guide track means for free movement therealong.

Connection between the mounting plate member 60 and the door, such as door 13 illustrated in FIG. 1, is accomplished by a pair of vertical hinge pins 80, 80 which pass through suitable aligned openings near the opposite ends of a lower door mounting bracket 81 having a generally U-shaped cross section defined by a pair of parallel spaced upper and lower wall portions 82, 83 and an intervening web wall 84 (see FIG. 2). The upper or outer ends of the pins 80 are formed with enlarged head sections 85 to prevent the pins from sliding through the openings in the bracket walls 82 and 83, and the lower end of each pin 80 is riveted over (see FIG. 6) after assembly thereon of a compression coil spring means 86 and one of the rotatably mounted guide rollers 75 or 76 as the case may be. Thus the rollers 75 and 76 are attached to the lower door mounting bracket 81.

Bracket 81 is adapted for attachment to the lower interior corner of a door, such as door 13, generally in accordance with the practice followed in connecting or joining the upper door mounting bracket 30 to door 13 (see FIG. 1). That is to say the web wall 84 of the lower mounting bracket is provided with suitable space slotted openings 87 receptive of mounting screws 88, 88 whereby bracket 81 is fixed to the inner face of the door panel as described.

Figure 7:
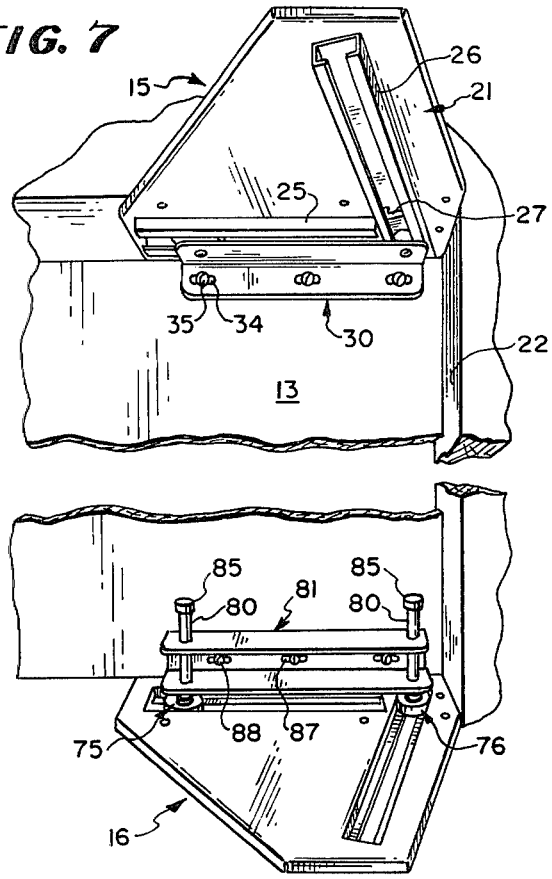
FIGS. 7–9 are perspective views illustrating sequential operational movements of a door equipped with the suspension hardware of FIG. 2.

As previously related, the two hardware assemblies 15 and 16 are mounted one above the other in operating position, with the respective door mounting brackets 30 and 81 thereof affixed to the inside face of one of the door panels adjacent the upper and lower corner margins thereof and parallel to the upper and lower edges of the door. This relationship is best understood from examining FIG. 7, for example. It will be noted from the illustrated case that the two side edges 41 and 62 of the upper and lower hardware assemblies, respectively, may be butted against the side frame member 22 of the door opening as shown in FIG. 7. This assists in properly locating the hardware assemblies laterally of the door opening an in registeringly aligning the same for operation. The leading edges 40 and 61 of the two hardware assemblies respectively, are generally registeringly aligned so that the outer face of the door when installed in the door opening lies flush with the face of wall 12 or slightly inset therefrom, as desired. This position of the mounting plates 21 and 60 may be accomplished quite simply by appropriate measurement from the face of wall 12.

Figure 8:
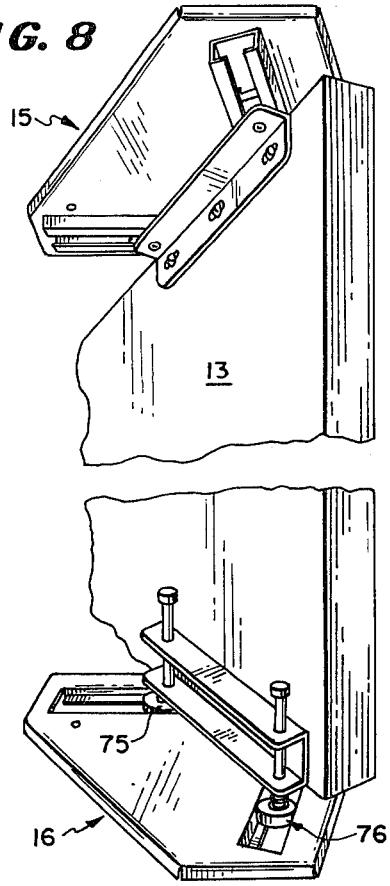
Figure 9:
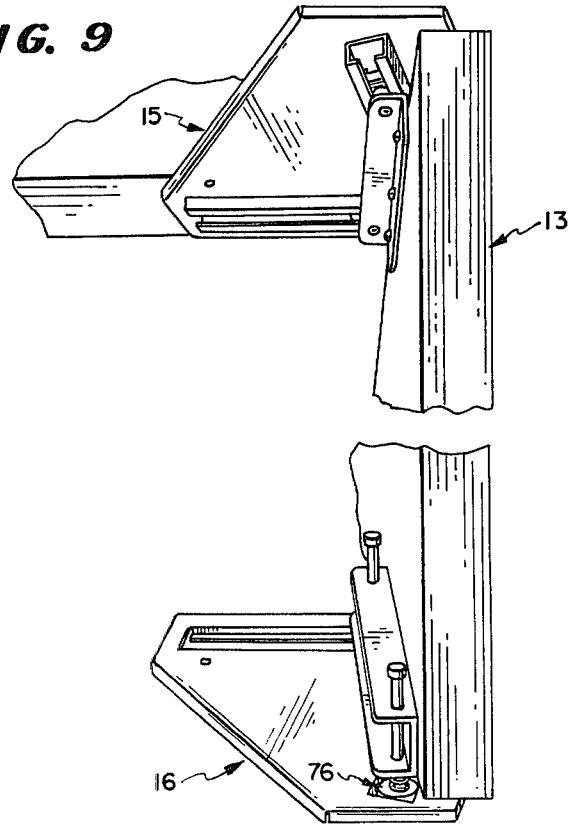

Turning now to the operational views of FIGS. 7 through 9 of the drawings, it will be understood from examining FIG. 7 for example, that the door 13 is therein shown from its backside, within the closet space 10, to illustrate the positioning of parts for the two assemblies 15 and 16 when door 13 is closed. In this closed position, the door 13 is engaged with a stop means 90 (see FIG. 1) normally attached to the overhead framework in an appropriate position to locate the door panel 13 in either coplanar or parallel relation with the face of wall 12 when the door is in its closed position. To initiate door opening movement, the user pulls on a suitable handle, such as illustrated at 92 in FIG. 1, swinging the door outwardly from the plane of wall 12 and causing the suspension guide means 27 to move simultaneously along the angularly disposed overhead track means 25 and 26 while simultaneously moving the guide rollers 75 and 76 along their respectively associated recessed track means 70, 71 in the underlying ground engaging assembly 16.

It will be noted that the intermediate positioning of parts when the door is substantially half-way open is illustrated in FIG. 8 while its fully open position is as set out in FIG. 9. When fully open, the guide means 27 in the lateral track means 25 and the guide rollers 75 in the underdisposed track means 70 are substantially at the end of their respective tracks. Correspondingly, the suspension guide means 27 in track means 26 and roller 76 in the track means 71 are likewise at or near the innermost ends of such tracks means. It also is to be noted that when open, door 13 lies across the header substantially at right angles to the plane of wall 12 parallel to the side frame member 22 and partly within and partly without the closet space (see FIG. 1). Door opening and closing movements are smooth and uninterupted with the weight of the door being carried entirely from and by the overhead assembly 15 with the underlying or ground engaging assembly 16 acting as means for guiding the lower edge of the door. The presence of the spring members 86 between the door mounting bracket 81 and the guide rollers 75, 76 in the lower assembly 16 serve to accommodate the vertical positioning of the pins 80 and rollers with a range of distances, thereby permitting variations in the gap or clearance beneath the door to accommodate different floor coverings, such as carpet or tile.

It will be recognized by those of skill in the art that while the installation herein illustrated concerns a two-panel installation, wider closet openings requiring more panels can be served by installing appropriate assemblies 15 and 16 spaced along the lateral dimension of the closet opening, each door requiring the two such assemblies for its full support and operational control.

From the foregoing it is believed that those familiar with the art will readily recognize and appreciate the advancement presented by the current invention over prior door suspension systems and will further recognize that while the present invention has been described in association with a preferred embodiment thereof illustrated in the accompanying drawings, the same is sucseptible to variation and substitution of equivalence without departing from the spirit and scope of the invention.

The embodiments of the invention in which an exclusive property or privilege is claimed are defined as follows:

1. A suspension system for supporting an interior door and the like in a door opening framed by vertical side members, a horizontal header and an under-supporting floor, comprising: an overhead hardware assembly including a unitary mounting plate and means for attaching the same to the door frame header, a floor engaging hardware assembly having a unitary mounting plate and means for attaching the same to the under-supporting floor, two intersectingly related linear track means associated with each said mounting plate; one said track means of each assembly paralleling the plane of the door opening and the other thereof disposed in acute angular relation to said one track means and extending across one end thereof; the track means of the two assemblies being registeringly aligned in operation, a single guide member disposed in each said track means for movement therealong; plural door brackets attached to the inside face of the door, one adjacent each said mounting plate; and means pivotally connecting the guide members of each assembly to an adjacent door bracket so that the guide members of the two assemblies are pivotal about two spaced vertical axes, equi-distant from said inside face of the door, whereby the door is movable simultaneously about said vertical axes and along said linear track means between a closed position paralleling the plane of the door opening, and an open position in which the door lies across the plane.

2. The suspension system of claim 1 wherein each said track means of the overhead assembly is substantially U-shaped in cross-section and innertedly depends benarth said mounting plate therefor to support a guide member therein, so that the weight of the door is carried by said overhead assembly.

3. The suspension system of claim 1 wherein each said track means of the floor engaging assembly is recessed inwardly of the upper face of said mounting plate associated therewith; the recess depth of each said track means being less than the thickness of said mounting plate; the said floor engaging assembly guiding the lower edge of the door in operation.

4. The suspension system of claim 1 wherein said means connecting the guide members to a door bracket in the floor engaging assembly comprises spring means operable to urge said guidemeans into said track means associated therewith.

5. The suspension system of claim 1 wherein both of said hardware assemblies are mounted in the door opening such that the other said track means thereof extend beyond one side of the door frame header, and the said door brackets are attached to the door near corresponding upper and lower corners thereof so that such corners are disposed beyond said one side of the door frame header in the door's open position.

* * * * *

UNITED STATES PATENT AND TRADEMARK OFFICE

CERTIFICATE OF CORRECTION

PATENT NO. : 4,306,377

DATED : December 22, 1981

INVENTOR(S) : John G. Sterling and Richard G. Kluge

It is certified that error appears in the above—identified patent and that said Letters Patent is hereby corrected as shown below:

Column 3, line 18, "ward" should be --ware--.

Column 8, line 16, "narth" should be --neath--; and in

Column 8, line 15, "innertedly" should be --invertedly"

Signed and Sealed this

*Sixth* Day of *April 1982*

[SEAL]

*Attest:*

GERALD J. MOSSINGHOFF

*Attesting Officer* *Commissioner of Patents and Trademarks*